US007553068B2

(12) United States Patent
Cabezas Jurin et al.

(10) Patent No.: US 7,553,068 B2
(45) Date of Patent: Jun. 30, 2009

(54) LEVER ESCAPEMENT FOR A TIMEPIECE

(75) Inventors: Andrés Cabezas Jurin, Yverdon-les-Bains (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/105,492

(22) Filed: Apr. 18, 2008

(65) Prior Publication Data

US 2008/0259739 A1 Oct. 23, 2008

(30) Foreign Application Priority Data

Apr. 18, 2007 (EP) ..... 07106375

(51) Int. Cl.
*G04B 15/00* (2006.01)

(52) U.S. Cl. ..... 368/132; 368/124; 368/129

(58) Field of Classification Search ..... 368/124–138
See application file for complete search history.

(56) References Cited

U.S. PATENT DOCUMENTS

| | | | | |
|---|---|---|---|---|
| 594,446 | A | 11/1897 | Voigt | |
| 1,091,261 | A | 3/1914 | Walker | |
| 2,531,273 | A * | 11/1950 | Jaccard | 368/127 |
| 6,802,645 | B2 | 10/2004 | Ludwig | |
| 7,097,350 | B1 | 8/2006 | Conus | |
| 2005/0128880 | A1 * | 6/2005 | Hayek et al. | 368/124 |
| 2006/0221774 | A1 | 10/2006 | Conus et al. | |

FOREIGN PATENT DOCUMENTS

| | | |
|---|---|---|
| CH | 4698 | 3/1892 |
| CH | 373703 | 1/1964 |
| EP | 0 018 796 | 11/1980 |
| EP | 1 045 297 | 10/2000 |
| EP | 1 367 462 A1 | 12/2003 |
| EP | 1 708 047 | 10/2006 |

OTHER PUBLICATIONS

European Search Report issued in corresponding application No. EP 07 10 6375 completed Feb. 14, 2008.
Daniels, George, "La Montre: Principes et Methodes de Fabrication," 1993, pp. 247-248.
Chamberlain, P. M., "It's About Time—The Lever Escapement," 1978, pp. 77-81.
Daniels, George, "La Montre: Principes et Methodes de Fabrication," 1993, pp. 236-248.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The lever escapement includes at least one escape wheel (2). The pallet assembly (5) is fitted with locking pallet stones (6, 7) and a first impulse pallet stone (8) cooperating with the teeth of the wheel (2). The pallet assembly (5) drives an auxiliary wheel set (9) carrying a second impulse pallet stone (10) cooperating with the teeth of the wheel (2).

9 Claims, 3 Drawing Sheets

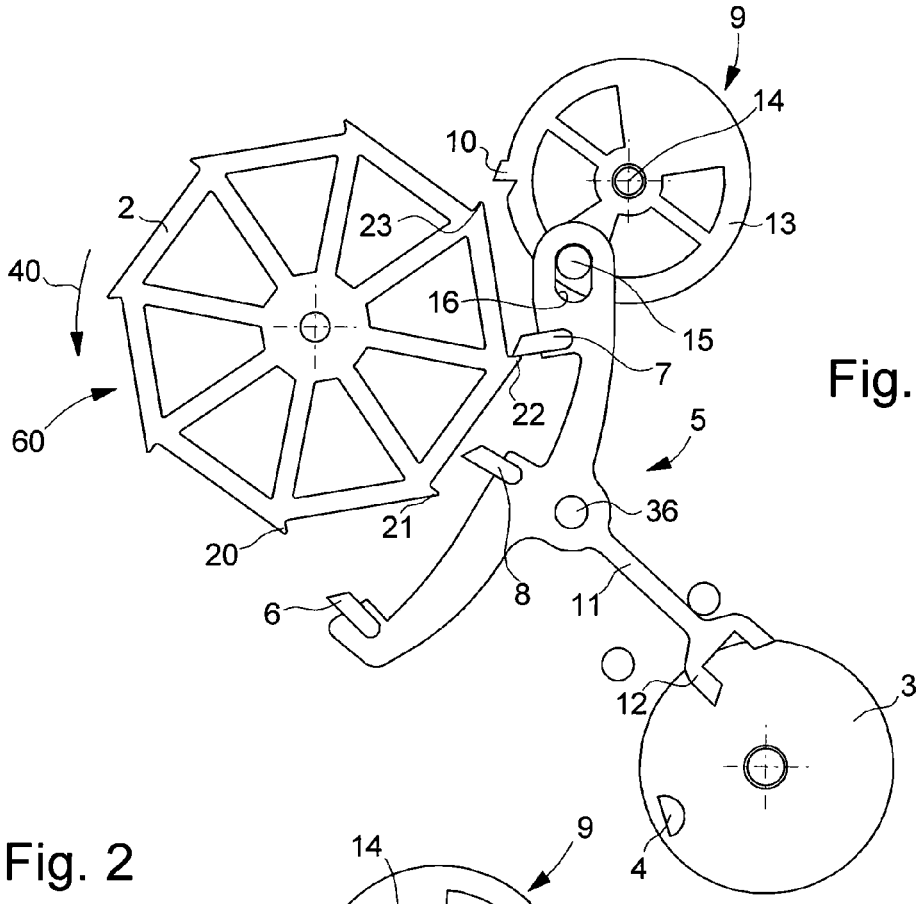
Fig. 1
Fig. 2
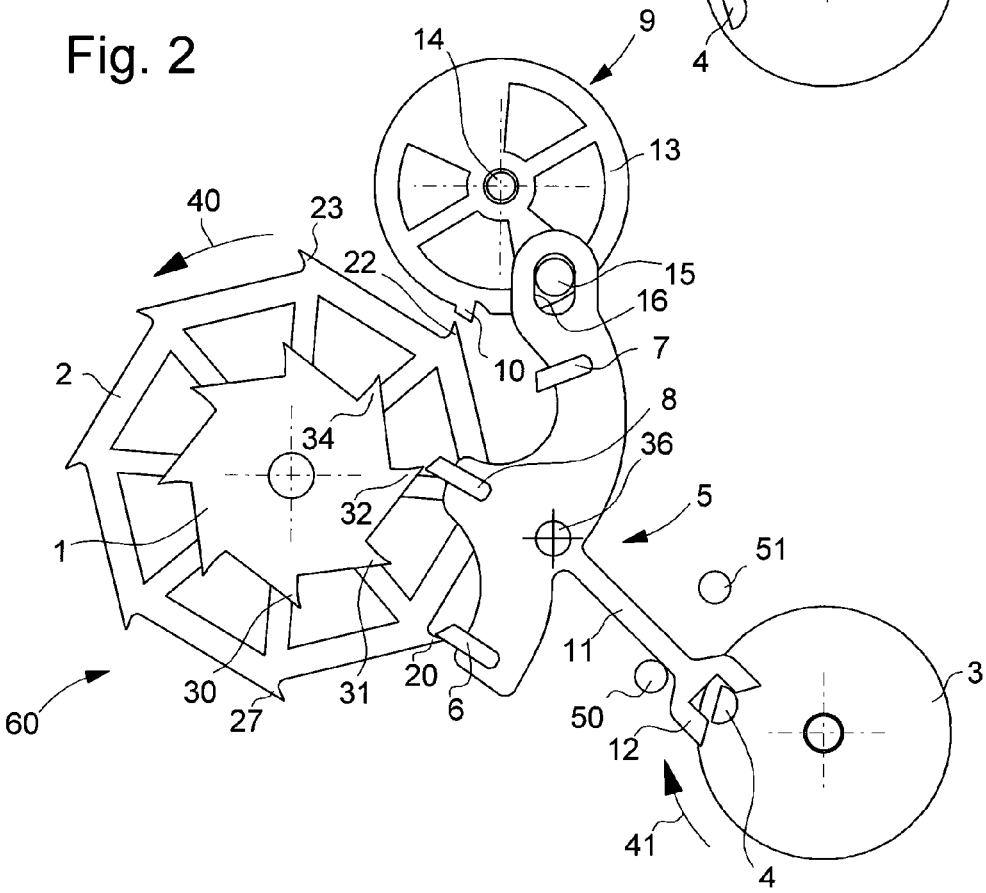

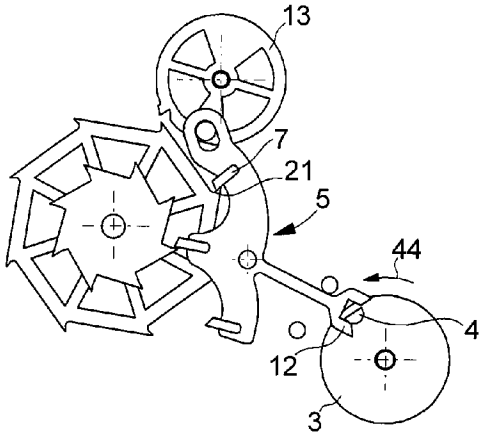
Fig. 9
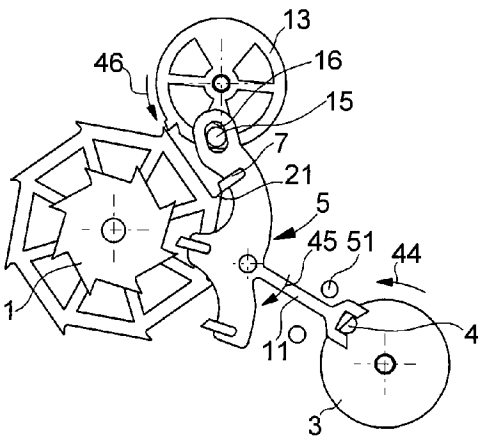
Fig. 10
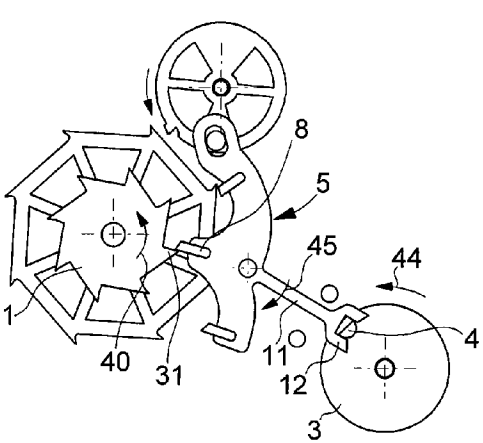
Fig. 11
Fig. 12
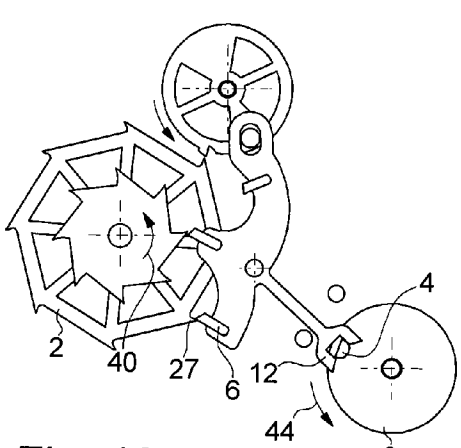
Fig. 13
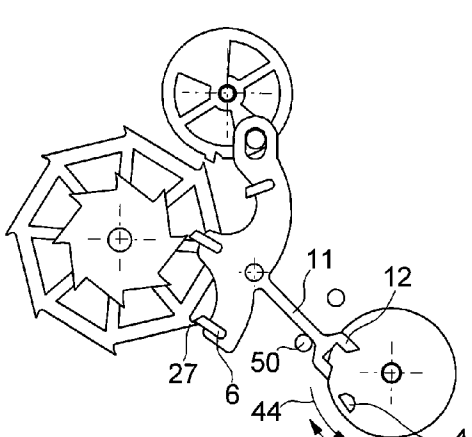
Fig. 14

LEVER ESCAPEMENT FOR A TIMEPIECE

This application claims priority from European Patent Application No. 07106375.4, filed Apr. 18, 2007, the entire disclosure of which is incorporated herein by reference.

FIELD OF THE INVENTION

The invention relates to a lever escapement for a timepiece, including an escape wheel set fitted with at least one wheel, a balance roller carrying an impulse pin and a pallet assembly arranged for cooperating with the impulse pin, said pallet assembly being provided with first and second locking pallet stones and an impulse pallet stone, said pallet stones being arranged for cooperating with the teeth of the escape wheel set.

BACKGROUND OF THE INVENTION

A lever escapement broadly answering the description given in the above paragraph is known and disclosed in the work entitled "La Montre: principes et méthodes de fabrication", Scriptar Editions S. A., La Conversion, Lausanne 1993. This escapement is explained in pages 247 and 248 of said work. As may be understood upon reading this document the escapement further includes a second impulse pallet stone secured to the balance roller and cooperating with the escape wheel.

It is an object of the invention to provide an escapement structure that allows the impulses supplied by the pallet onto the balance wheel via the respective pallet stones to have for each alternation, a substantially identical amount of energy. The amount of energy is set to avoid any excessive rotational amplitude of the balance wheel thereby avoiding any risk of missing impulses and, therefore, limiting the energy wasted.

SUMMARY OF THE INVENTION

In addition to complying with the statement of the first paragraph of this description, the present invention is characterized in that the pallet assembly drives an additional wheel set, this wheel set including a second impulse pallet stone arranged for cooperating with the teeth of the escape wheel.

BRIEF DESCRIPTION OF THE DRAWINGS

The invention will now be explained in detail below via two embodiments, given by way of non-limiting example, these embodiments being illustrated by the drawings, in which:

FIG. 1 is a plan view of a first embodiment of the escapement according to the invention, FIG. 2 is a plan view of a second embodiment of the escapement according to the invention which illustrates the start of unlocking of the escape wheel, and FIGS. 3 to 14 are plan views explaining the operating phases of the escapement in accordance with the second embodiment of the invention, these phases covering one complete oscillation of the balance roller.

DETAILED DESCRIPTION OF THE ILLUSTRATIVE EMBODIMENTS

Figure 5:
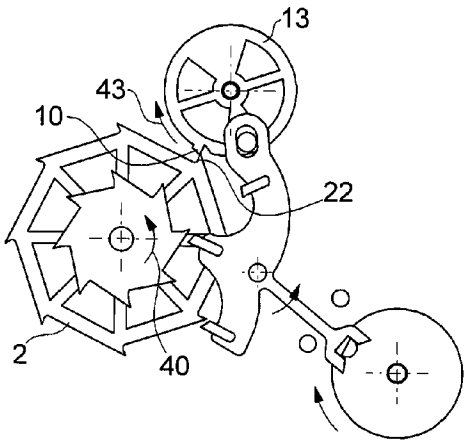

FIG. 1 is a plan view of the escapement mechanism according to a first embodiment of the present invention. This escapement includes an escape wheel set 60 fitted with a single escape wheel 2. In a known manner, this wheel is driven by a gear train, which is itself driven by a barrel, the gear train and barrel not being shown in FIG. 1. When wheel 2 is free, it rotates in the anticlockwise direction as indicated by arrow 40. The escapement also includes a roller 3, which is associated with a sprung balance that is not shown. The roller carries an impulse pin 4. A pallet assembly 5 mounted on a pivot 36 is arranged for cooperating with impulse pin 4 of roller 3. In a known manner, the pallet assembly carries a stick 11 ending in a fork 12, which can be penetrated by impulse pin 4 of roller 3. The pallet assembly is fitted with first and second locking pallet stones 6 and 7 and an impulse pallet stone 8, these pallets being arranged for cooperating with teeth 20, 21, 22 . . . of escape wheel 2.

As is shown clearly in FIG. 1, the present invention is characterized in that pallet assembly 5 drives an auxiliary wheel set 9, which is not coaxial to the roller 3. The auxiliary wheel set 9 carries a second impulse pallet stone 10 arranged for cooperating with teeth 21, 22, 23, . . . of escape wheel 2.

More specifically, the embodiment given here by way of example includes a disc 13 as auxiliary wheel set. This disc 13 is articulated on a pivot 14 and carries at its periphery said second auxiliary pallet stone 10 and a pin 15, which is trapped in an oblong aperture 16 made in pallet assembly 5. Pin 15 and aperture 16 thus form a moving hinge like a toggle joint or knee type joint.

The auxiliary wheel set is not limited to the embodiment described above. Indeed, without the necessity of illustrating this in a drawing, this wheel set 9 could be a lever hinged on a pivot carrying said second impulse pallet stone 10 and a toothed sector meshing with a rack secured to pallet assembly 5.

FIG. 2 is a plan view of a second embodiment of the invention. Here, the escape wheel set 60 is not a single wheel, but includes first and second wheels 1 and 2 secured to each other and mounted coaxially on each other. In this second embodiment, the first impulse pallet stone 8 cooperates with the first wheel 1, whereas the second impulse pallet stone 10, and the first and second locking faces 6 and 7, cooperate with the second wheel 2. This is the same innovation that characterized the first embodiment, namely the implementation of auxiliary wheel set 9, controlled by pallet assembly 5.

The Figures accompanying the description of the second embodiment are plan views. However, without the necessity of showing this in cross-section, it will be clear that pallet assembly 5 with the first impulse pallet stone 8 are located at the level of or at the first escape wheel 1, whereas the first and second locking pallet stones 6 and 7 carried by pallet assembly 5 extend at the level of teeth 20, 21, 22, . . . of second escape wheel 2. It will also be clear that auxiliary wheel set 9 is located at the level or at second escape wheel 2.

The operation of the escapement according to the invention will now be described. In order to do so, we will use the second embodiment, comprising two escape wheels. One complete oscillation of roller 3 is illustrated in FIGS. 3 to 14. The various operating phases will be examined below.

Figure 3:
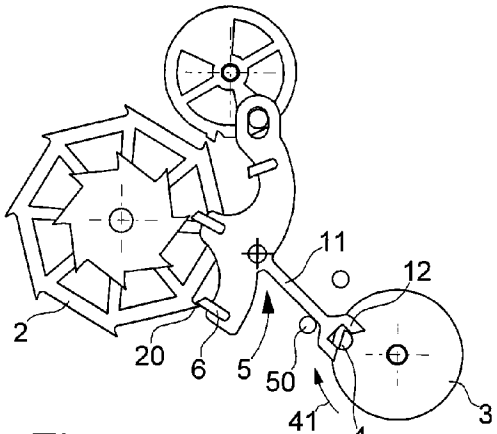

In FIG. 3, roller 3 is rotating in the direction of arrow 41. The second escape wheel 2 is locked via its tooth 20 on first locking pallet stone 6 of pallet assembly 5. Stick 11 of pallet assembly 5 is abutting on a first banking pin 50. Impulse pin 4 of roller 3 enters into contact with fork 12 of lever 11. This is the start of the unlocking of wheel 2.

Figure 4:
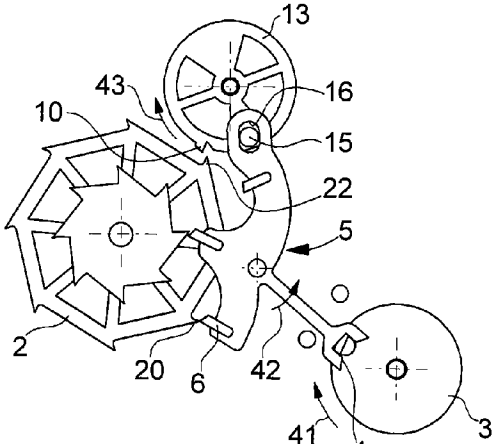

In FIG. 4, roller 3 has continued its travel in the direction of arrow 41. Impulse pin 4 has driven pallet assembly 5 in the direction of arrow 42, forcing locking pallet stone 6 to slide along tooth 20 of wheel 2 to exit the hold of the latter. While rotating in the direction of arrow 42, oblong hole 16 of pallet assembly 5 drives pin 15 of disc 13 to rotate the latter in the direction of arrow 43. Second impulse pallet stone 10 of disc 13 is thus made to intersect the trajectory of tooth 22 of wheel 2. This is the end of the unlocking and start of the release of wheel 2.

As FIG. 5 shows, the released wheel 2 is driven by the timepiece gear train rotates in the direction of arrow 40 and its tooth 22 has entered into contact with impulse pallet stone 10. This is the start of the impulse phase on disc 13.

Figure 6:
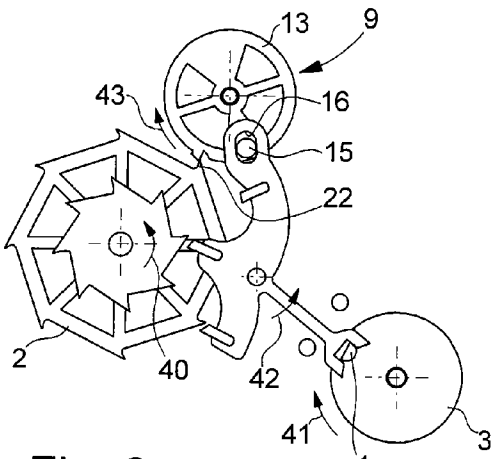

In FIG. 6, tooth 22 of wheel 2 is at the end of the impulse and has relaunched or restarted disc 13 in the same direction that it had until now (arrow 43). Pin 15 trapped in oblong hole 16 drives pallet assembly 5 in the direction of arrow 42, which simultaneously restarts roller 3 via its impulse pin 4 in the direction of arrow 41. This is the end of the impulse on additional wheel set 9.

Figure 7:
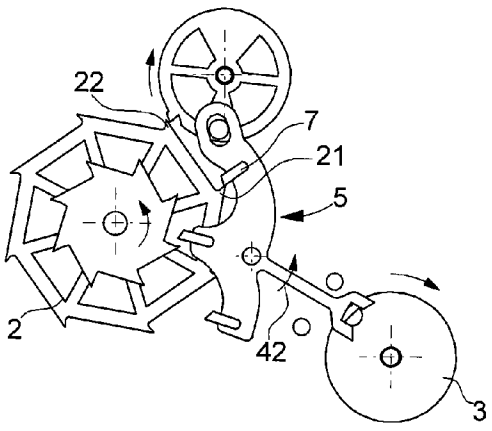

As FIG. 7 shows, pallet assembly 5 continues to tip in the direction of arrow 42, such that its second locking pallet stone 7 intersects the trajectory of the teeth of wheel 2 causing tooth 21 thereof to abut against locking pallet stone 7. This is the lock phase that locks wheel 2.

Figure 8:
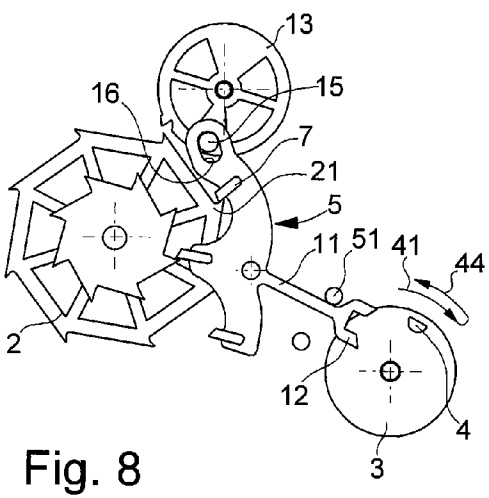

FIG. 8 shows the total lock state. Impulse pin 4 has escaped from fork 12 forcing stick 11 of pallet assembly 5 to abut against a second banking pin 51. Disc 13 is also locked, its pin 15 abutting the bottom of oblong hole 16. The locking pallet stone is fully engaged on tooth 21 by the draw effect. From this moment, the roller continues its supplementary arc still in the same direction 41, and then retraces its steps to rotate in the direction of arrow 44. FIG. 9 shows the same situation as that shown in FIG. 8, except that impulse pin 4, returning in the direction of arrow 44, has entered into contact with fork 12 of pallet assembly 5. This is the beginning of the unlocking of locking pallet stone 7.

As is apparent in FIG. 10, impulse pin 4, continuing its travel in the direction of roller 3, has separated stick 11 from banking pin 51, pallet assembly 5 rotating then in the direction of arrow 45. This movement causes locking pallet stone 7 to slide along tooth 21 of wheel 2 to leave the hold thereof. While rotating in the direction of arrow 45, oblong hole 16 of pallet assembly 5 drives pin 15 of disc 13 to rotate the latter in the direction of arrow 46. This is the end of unlocking and start of release of wheel 1, secured to wheel 2.

FIG. 11 shows that wheel 1, driven by the timepiece gear train, has rotated in the direction of arrow 40. Tooth 31 of wheel 1 enters into contact with the first impulse pallet stone 8 fitted to pallet assembly 5. This is the start of the impulse that is transmitted to roller 3 via stick 11 (which is rotating in the direction of arrow 45), fork 12 and impulse pin 4. The roller is then relaunched or restarted in the direction of arrow 44.

FIG. 12 shows the end of the impulse of tooth 31 of wheel 1 on impulse pallet stone 8 of pallet assembly 5. While continuing to rotate in the direction of arrow 45, the first locking pallet stone 6 of pallet assembly 5 intersects the trajectory of the teeth of wheel 2. With the aid of pin 15-oblong hole 16, disc 13 progresses in the direction of arrow 46 to occupy a position more or less similar to that shown in FIG. 3, i.e. that which it occupied at the start of the oscillation examined here.

FIG. 13 shows that wheel 2 has continued to rotate in the direction of arrow 40 and its tooth 27 has entered into contact with locking pallet stone 6, which locks wheel 2. Impulse pin 4 of roller 3 is on the point of leaving fork 12. This is a new locking phase.

FIG. 14 shows the total lock of tooth 27 on locking pallet stone 6. The draw effect exerted by the rotational force of wheel 2 causes the tip of tooth 27 to climb along locking pallet stone 6. Stick 11 of pallet assembly 5 abuts against banking pin 50. From this moment, the roller continues its supplementary arc in the direction of arrow 44, and then retraces its steps in the opposite direction (arrow 41). When impulse pin 4 again penetrates fork 12, we return to the situation described with reference to FIG. 3 and a new cycle or oscillation can begin.

What is claimed is:

1. A lever escapement for a timepiece including an escape wheel set fitted with at least one wheel, a balance roller carrying an impulse pin and a pallet assembly arranged for cooperating with the impulse pin, said pallet assembly being fitted with first and second locking pallet stones and an impulse pallet stone, said pallet stones being arranged for cooperating with the teeth of the escape wheel, wherein the pallet assembly drives an auxiliary wheel set carrying a second impulse pallet stone arranged for cooperating with the teeth of said escape wheel, and wherein said auxiliary wheel set is not coaxial to said balance roller.

2. The escapement according to claim 1, wherein the pallet assembly carries a stick ending in a fork which can be penetrated by the impulse pin of the roller.

3. The escapement according to claim 1, wherein the auxiliary wheel is a disc hinged on a pivot carrying said second impulse pallet stone at the periphery thereof and a pin trapped in an oblong aperture made in the pallet assembly.

4. The escapement according to claim 1, wherein the auxiliary wheel set is a lever hinged on a pivot carrying said second impulse pallet stone and a toothed sector meshing with a rack secured to the pallet assembly.

5. The escapement according to claim 1, wherein the escape wheel set includes first and second coaxial wheels secured to each other, wherein the first impulse pallet stone cooperates with the first wheel and wherein the second impulse pallet stone and the first and second locking pallet stones cooperate with the second wheel.

6. The escapement according to claim 5, wherein the pallet assembly carries a stick ending in a fork which can be penetrated by the impulse pin of the roller.

7. The escapement according to claim 5, wherein the auxiliary wheel is a disc hinged on a pivot carrying said second impulse pallet stone at the periphery thereof and a pin trapped in an oblong aperture made in the pallet assembly.

8. The escapement according to claim 5, wherein the auxiliary wheel set is a lever hinged on a pivot carrying said second impulse pallet stone and a toothed sector meshing with a rack secured to the pallet assembly.

9. The escapement according to claim 5, wherein the pallet assembly is located on the first escape wheel, the first and second locking pallet stones extend at the level of the teeth of the second escape wheel and wherein the auxiliary wheel set is located at the level of said second escape wheel.

* * * * *